US010480256B2

(12) United States Patent
Stave et al.

(10) Patent No.: US 10,480,256 B2
(45) Date of Patent: Nov. 19, 2019

(54) RISER SYSTEM FOR COUPLING SELECTABLE MODULES TO THE RISER

(71) Applicant: Enhanced Drilling, Inc., The Woodlands, TX (US)

(72) Inventors: Roger Sverre Stave, Straume (NO); John Cohen, Houston, TX (US)

(73) Assignee: Enhanced Drilling, Inc., The Woodlands, TX (US)

( * ) Notice: Subject to any disclaimer, the term of this patent is extended or adjusted under 35 U.S.C. 154(b) by 0 days.

(21) Appl. No.: 15/850,730

(22) Filed: Dec. 21, 2017

(65) Prior Publication Data

US 2018/0179827 A1 Jun. 28, 2018

Related U.S. Application Data

(63) Continuation of application No. PCT/US2015/038188, filed on Jun. 27, 2015.

(51) Int. Cl.

| | |
|---|---|
| ***E21B 17/01*** | (2006.01) |
| ***E21B 21/08*** | (2006.01) |
| ***E21B 21/00*** | (2006.01) |
| *E21B 7/128* | (2006.01) |
| *E21B 33/08* | (2006.01) |

(52) U.S. Cl.

CPC ..... *E21B 17/012* (2013.01); *E21B 17/01* (2013.01); *E21B 21/001* (2013.01); *E21B 21/08* (2013.01); *E21B 7/128* (2013.01); *E21B 33/085* (2013.01)

(58) Field of Classification Search

CPC ..... E21B 7/128; E21B 17/01; E21B 17/012; E21B 21/001; E21B 21/08; E21B 33/085

See application file for complete search history.

(56) References Cited

U.S. PATENT DOCUMENTS

| | | | | |
|---|---|---|---|---|
| 4,063,602 A * | 12/1977 | Howell | E21B 7/128 175/48 |
| 4,291,772 A * | 9/1981 | Beynet | E21B 21/08 175/25 |
| 6,102,673 A * | 8/2000 | Mott | E21B 21/001 137/596.17 |
| 6,454,022 B1 * | 9/2002 | Sangesland | E21B 21/08 175/5 |
| 6,966,367 B2 * | 11/2005 | Butler | E21B 21/001 166/105 |

(Continued)

FOREIGN PATENT DOCUMENTS

| | | | |
|---|---|---|---|
| WO | WO-2006054905 A1 * | 5/2006 | E21B 21/08 |
| WO | WO-2013024354 A2 * | 2/2013 | E21B 17/01 |

OTHER PUBLICATIONS

International Search Report and Written Opinion, International Application No. PCT/US2015/038188 dated Dec. 14, 2015.

*Primary Examiner* — Matthew R Buck
(74) *Attorney, Agent, or Firm* — Richard A. Fagin

(57) ABSTRACT

A drilling riser system includes a plurality of interchangeable dockable modules having sealable hydraulic connections configured to connect to a module docking structure disposed in at least one specific segment of a drilling riser and to seal the hydraulic connections. Each of the interchangeable dockable modules includes at least one of an hydraulic termination or connection to an hydraulic device for each of a fluid conduit in fluid communication with the and at least one auxiliary line associated with the riser.

15 Claims, 16 Drawing Sheets

(56) References Cited

U.S. PATENT DOCUMENTS

| | | | | |
|---|---|---|---|---|
| 7,270,185 | B2 * | 9/2007 | Fontana | E21B 7/12 166/347 |
| 7,690,135 | B2 * | 4/2010 | Yu | E02F 3/8858 37/309 |
| 7,913,764 | B2 * | 3/2011 | Smith | E21B 21/001 166/345 |
| 8,573,307 | B2 * | 11/2013 | Moksvold | E21B 17/085 166/345 |
| 9,428,975 | B2 * | 8/2016 | Stave | E21B 17/01 |
| 2010/0147528 | A1 * | 6/2010 | Baugh | E21B 19/004 166/355 |
| 2011/0101682 | A1 * | 5/2011 | Vatne | E21B 17/01 285/308 |
| 2012/0168171 | A1 * | 7/2012 | Varpe | E21B 21/106 166/363 |
| 2012/0193282 | A1 | 8/2012 | Wolf et al. | |
| 2012/0247782 | A1 | 10/2012 | Smith | |
| 2013/0192841 | A1 | 8/2013 | Feasey et al. | |
| 2014/0205385 | A1 * | 7/2014 | Bekker | E02F 3/90 406/113 |

* cited by examiner

RISER SYSTEM FOR COUPLING SELECTABLE MODULES TO THE RISER

CROSS REFERENCE TO RELATED APPLICATIONS

Continuation of International Application No. PCT/US2015/038188 filed on Jun. 27, 2015 and incorporated herein by reference in its entirely.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

The disclosure relates generally to the field of borehole drilling using a pump to lift drilling fluid out of the borehole so as to maintain a selected borehole pressure. More specifically, the disclosure relates to mud return pumps and methods for connecting such pumps to a drilling riser.

FIG. 1 shows an example "mud lift" drilling system using a drilling fluid ("mud") return pump when drilling from a drilling unit 1 comprising a derrick 6 above the surface 10 of a body of water. In construction of a sub-bottom borehole using the system in FIG. 1, a conductor pipe may first be driven into or jetted into formations below the water bottom 8. When drilling a borehole 15 from the drilling device, drilling fluid is pumped through a drill string 16 down to a drilling tool, usually including a drill bit (not shown). The drilling fluid serves several purposes, one of which is to transport drill cuttings out of the borehole 15. The drilling fluid flows back through an annular space ("annulus") 30 between the borehole wall, the liner or surface casing 14. The annulus 30 is typically in fluid communication with a drilling riser 12 at a wellhead (not shown) proximate the water bottom 8. The riser 12 may extent to a drilling unit 1, where the drilling fluid is treated and conditioned before being pumped back down the drill string 16 into the borehole 15. In many cases, the drilling fluid in the drilling riser 12 and the annulus 30 will result in a head of pressure in the borehole 15 that is undesirable.

By placing a pump 20 in fluid communication with the interior of the liner 14 near the water bottom 8, or making a similar fluid connection to the interior of the drilling riser 12 at a selected elevation, which may be above the water bottom 8, the returning drilling fluid may be pumped out of the annulus 30 and up to the drilling unit 1. The annular volume in the riser 12 above the drilling fluid may be filled with a riser fluid that is of a different composition than the drilling fluid. Preferably, the density of the riser fluid is less than that of the drilling fluid.

The drilling fluid pressure at the water bottom 8 may be controlled from the drilling unit 1 by selecting the inlet pressure to the pump 20. The height $H_1$ of the column of drilling fluid above the water bottom 8 depends on the selected inlet pressure of the pump 20, the density of the drilling fluid and the density of the riser fluid. The inlet pressure of the pump 20 is equal to: $P=(H1\gamma b+H_2\gamma s)*C$, wherein $\gamma b$=the density of the drilling fluid, $H_2$=the height of the column of riser fluid, $\gamma s$=the density of the riser fluid and C is a constant.

In order to prevent the drilling fluid pressure from exceeding an acceptable level (e.g., in the case of a pipe trip), the drilling riser 12 may be provided with a dump valve. A dump valve of this type may be set to open at a particular predetermined pressure for outflow of drilling fluid to the body of water.

The following describes a non-limiting example of a method and device illustrated in the accompanying drawings, in which, as noted above, FIG. 1 is a schematic view of a fixed drilling rig provided with a pump for the returning drilling fluid, the pump being coupled to the riser section near the seabed and the riser section or portion thereof being filled with a fluid of a different density than that of the drilling fluid.

Reference number 1 denotes a drilling unit comprising a support structure 2, a deck 4 and a derrick 6. The support structure 2 is placed on the water bottom 8 (or the support structure 2 may be affixed to flotation devices as is well known in the art) and projects above the surface 10 of the water. The riser section of the surface casing or liner 14 extends from the water bottom 8 up to the deck 4, while the liner 14 extends further down into the borehole 15. The drilling riser 12 may be provided with required well head valves such as a subsea blowout preventer assembly ("BOP") 104. The BOP 104 may include various devices known in the art to close the borehole 15 hydraulically when the drill string 16 is in the borehole 15, or when there is no drill string present.

The drill string 16 projects from the deck 4 and down through the liner 14. A first pump pipe 17 is coupled to the riser section 12 near the water bottom 8 via a valve 18 and the opposite end portion of the pump pipe 17 is coupled to a pump 20 placed near the seabed 8. A second pump pipe 22 runs from the pump 20 up to a collection tank 24 for drilling fluid on the deck 4.

A tank 26 for a riser fluid communicates with the riser section 12 via a connecting pipe 28 at the deck 4. The connecting pipe 28 may have a volume flow meter (not shown). In some embodiments, the density of the riser fluid is less than that of the drilling fluid. The riser fluid may be a gas in which case the tank 26 and connecting pipe 28 can be omitted.

The power supply to the pump 20 may be via an electrical or hydraulic cable (not shown) from the drilling unit 1. The pump 20 may be electrically driven, or may be driven hydraulically by means of oil that is circulated back to the drilling unit 1 or by means of water that is dumped in the sea from the pump 20 power fluid discharge. The pressure at the inlet to the pump 20 is selected from the drilling unit 1.

The drilling fluid is pumped down through the drill string 16 in a manner that is known in the art, for example, using a mud pump 27 which lift mud from a storage tank 24 and discharges drilling fluid ("mud") under pressure to the interior of the drill string 16. returning to the deck 4 through an annulus 30 between the liner or casing 14 (and the riser 12) and the drill string 16 through a return line 29. When the pump 20 is started, the drilling fluid is returned from the annulus 30 via the pump 20 to the storage tank 24 on the deck 4. Using such a system it is possible to obtain a significant reduction in the pressure of the drilling fluid in the borehole 15 and consequently a higher mud density may be used creating a different pressure gradient.

The riser 12 may include auxiliary fluid lines 100, 102 that may be in selective hydraulic communication with the borehole 15 below the BOP 100. Such lines may be known by names such as "choke line", "booster line", "kill line", etc., depending on the use of the individual line 100, 102.

SUMMARY

A drilling riser system according to one aspect of the present disclosure includes an interchangeable dockable module having sealable hydraulic connections configured to connect to a module docking structure disposed in at least one specific segment of a drilling riser and to seal the hydraulic connections. The interchangeable dockable modules includes at least one of an hydraulic termination or connection to an hydraulic device for each of a fluid conduit in fluid communication with the and at least one auxiliary line associated with the riser, and means for reconfiguring hydraulic connections to the specific riser segment to enable various drilling configurations.

Other aspects and possible advantages of systems and methods according to the present disclosure will be apparent from the description and claims which follow.

DETAILED DESCRIPTION

Figure 1:
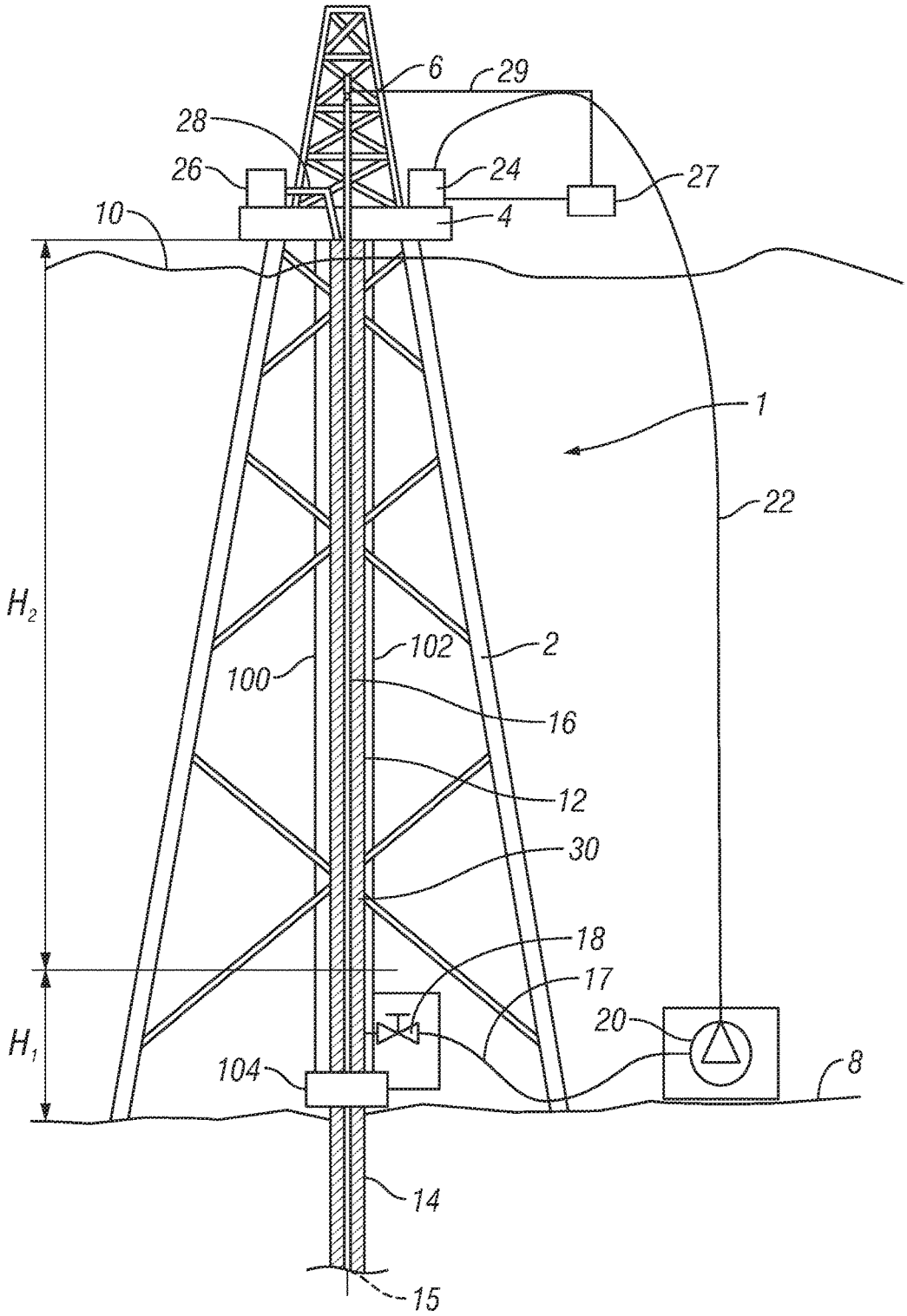
FIG. 1 (Prior Art)
FIG. 1 shows an example borehole drilling system using a pump to lift fluid from the borehole annulus so as to maintain a selected pressure in the borehole.
Figure 2:
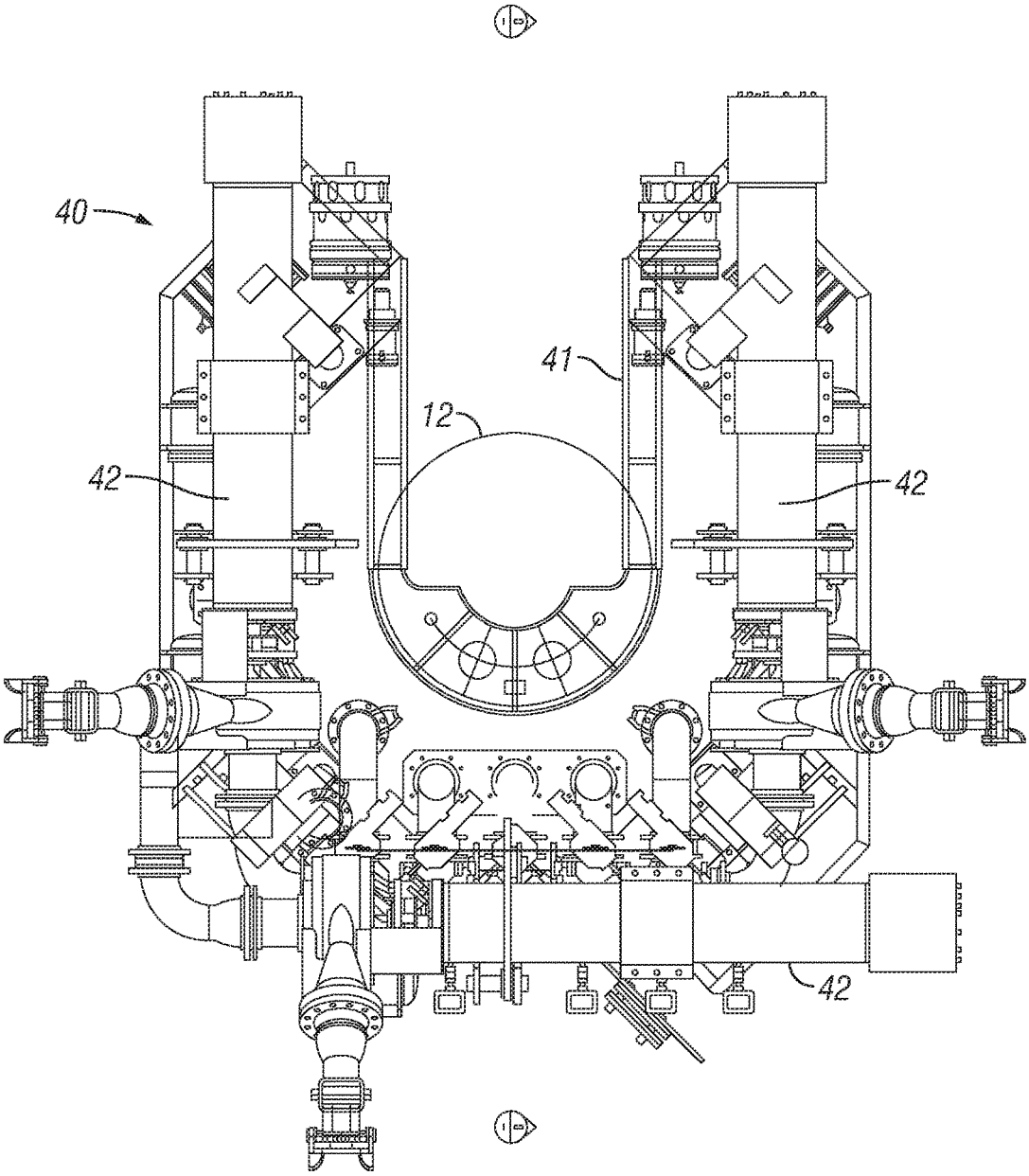
FIG. 2 shows an example embodiment of a horizontally oriented pump module in plan view.
Figure 3:
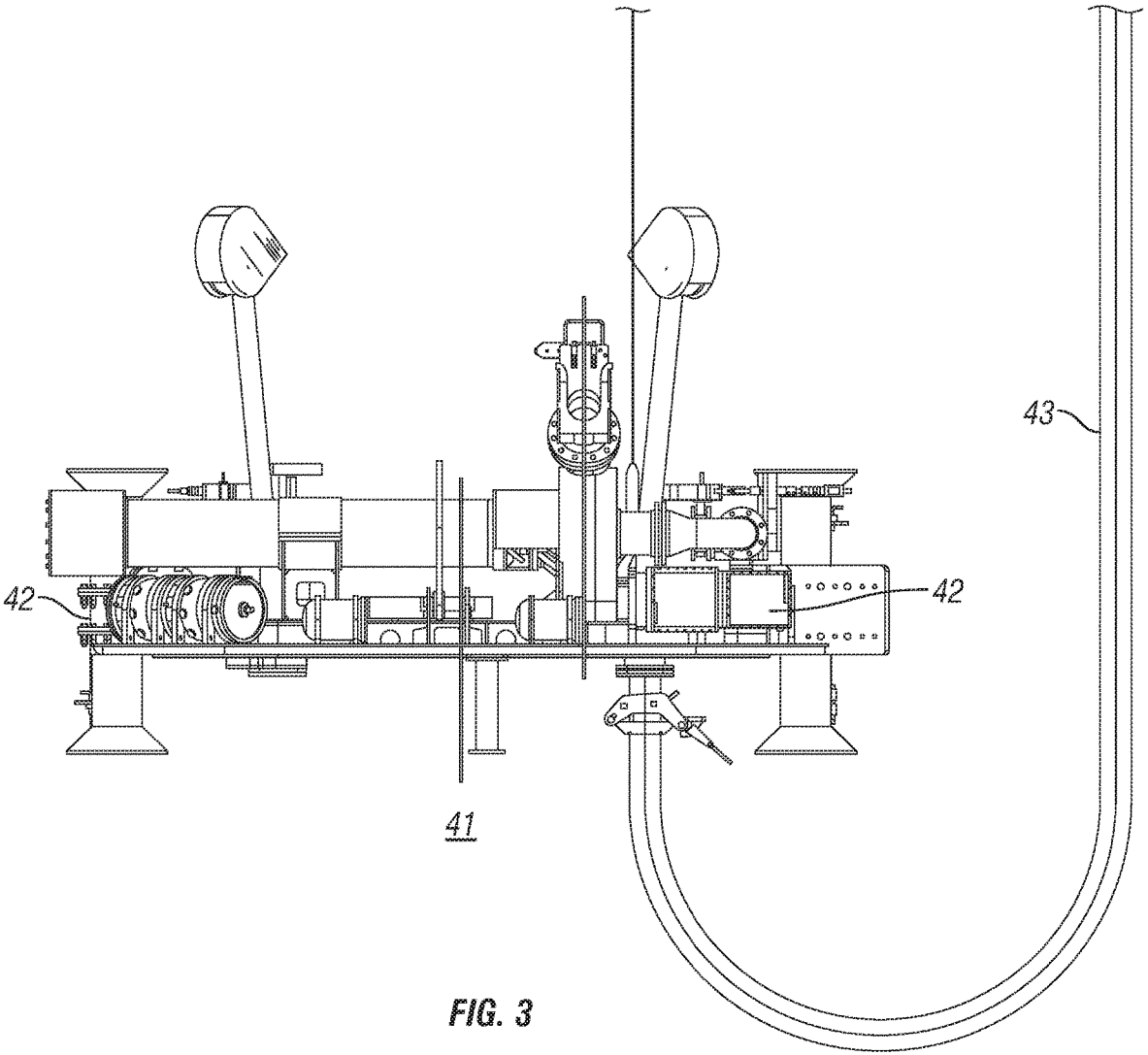
FIG. 3 shows the example embodiment of the module of FIG. 2 in side view with a mud return line.
Figure 4:
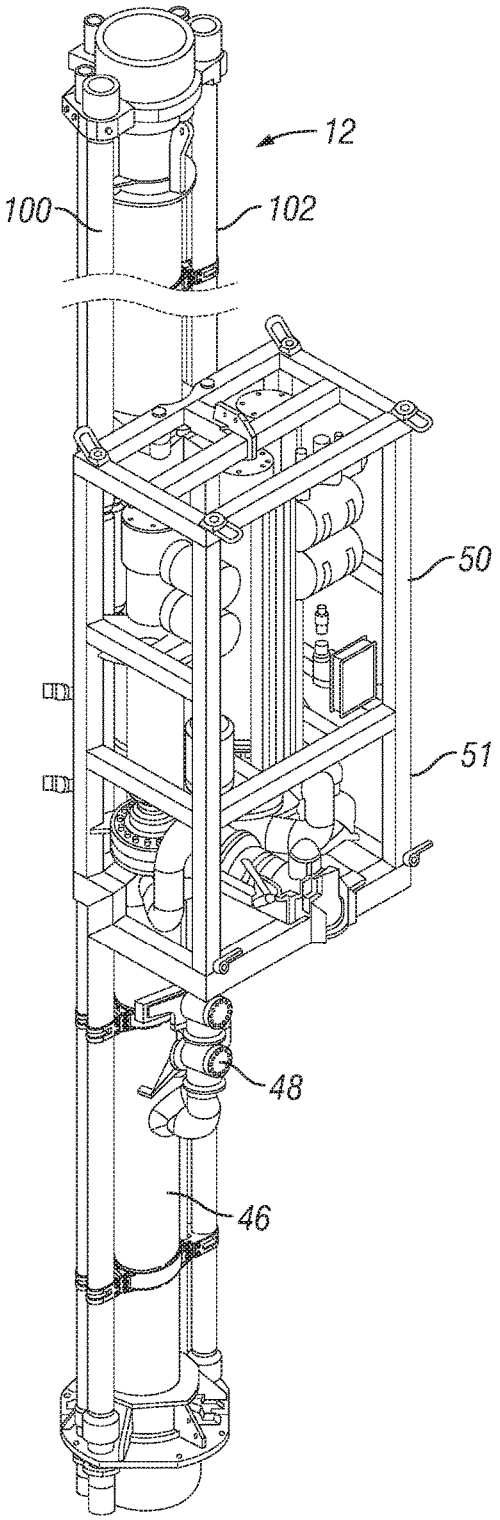
FIG. 4 shows an example embodiment of a vertically oriented pump module in side view docked to the riser, with specific riser joint having a fluid discharge line.
Figure 5:
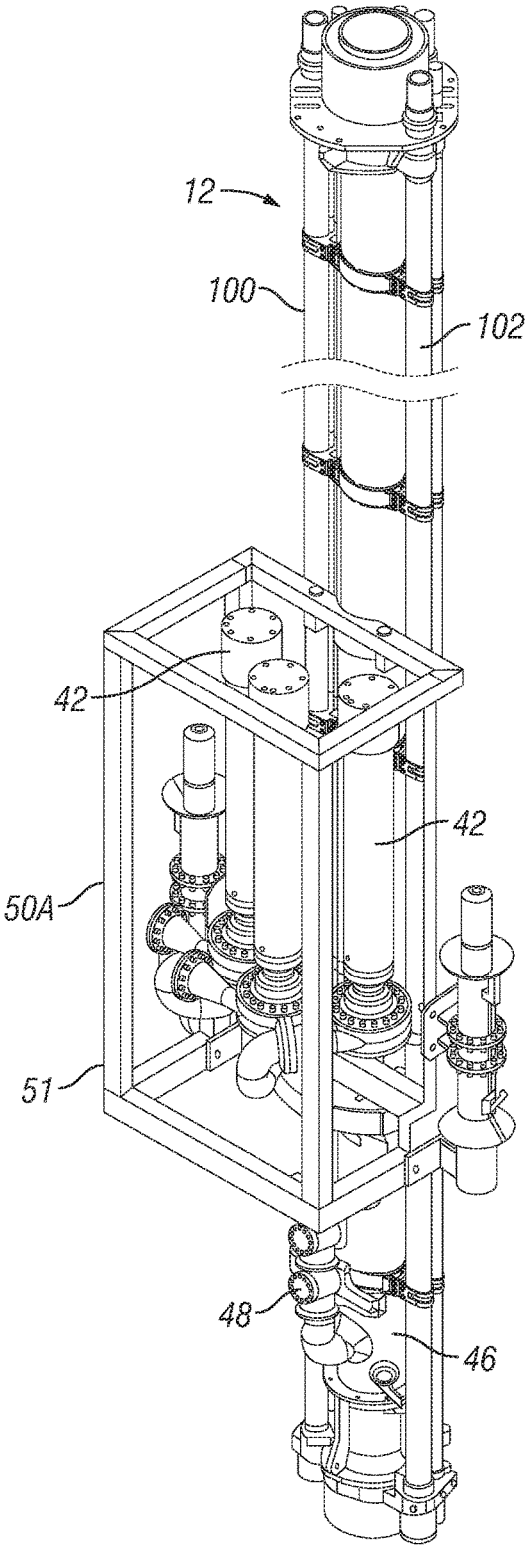
FIG. 5 shows another example embodiment of a vertically oriented pump module with guides and guide posts.

FIG. 2 shows one example of a type of interchangeable module, referred to as a "pump module" 40, that may be used with a drilling system such as shown in FIG. 1. The pump module 40 may be assembled to the riser (12 in FIG. 1) below the drilling platform (4 in FIG. 1), either in the body of water, for example, by using a remotely operated vehicle, or inside a "moon pool" of a floating drilling platform disposed above the water surface 10. The pump module 40 may be connected to a specific riser segment (explained below with reference to FIGS. 4 and 5) that has features for mating the pump module 40 both hydraulically and mechanically thereto. The pump module 40 may have one or more (three shown in FIG. 2) fluid pumps 42 that are in fluid communication on an inlet side thereof with a fluid discharge (see FIG. 8) disposed in or forming part of a specific riser segment (FIGS. 4 and 5). A fluid discharge of the fluid pumps 42 is shown in FIG. 3 at 43 and is in fluid communication with one or more lines extending to the drilling platform to return drilling fluid to the drilling unit (1 in FIG. 1). The fluid discharge of the fluid pumps 42 may, in other embodiments, be connected to one or more of the auxiliary lines associated with the riser, e.g., lines shown at 100 and 102 in FIG. 7. Such connection would require minor reconfiguration of the fluid discharge (43 in FIG. 3) to conform to a lower end coupling of the auxiliary line(s) on the riser joint immediately above the pump module 40. The fluid pumps 42 in the present embodiment may be mounted on a platform or plate structure 41 that may include a semi-circular opening on one side (FIG. 3) to enable engagement with a mating feature (not shown) on the specific riser segment (described below with reference to FIGS. 4 and 5). Features such as an externally mounted ring (not shown) may be provided on the specific riser segment to hold the plate structure 41 in a selected axial position along the specific riser segment. A possible advantage of the configuration of the pump module 40 shown in FIGS. 2 and 3 is that its weight may be more evenly circumferentially distributed around the riser (12 in FIG. 1) thus reducing lateral stresses on the riser (12 in FIG. 1).

FIGS. 4 and 5 show two different examples of a vertically mounted pump module, 50 and 50A, respectively, each coupled to the specific riser segment 46 of the riser 12. The respective pump modules 50, 50A each may include one or more fluid pumps, shown at 42 in FIG. 5, mounted in a box frame structure 51. The box frame structure 51 may be generally in the shape of an open rectangular box and may include features (described below) to couple the box frame structure 51 to the specific riser segment 46, and to make hydraulic connection between the fluid pump(s) 42 fluid inlet and a riser fluid discharge. Longitudinally (with respect to the riser 12) below each pump module 50, 50A the specific riser segment 46 may include a fluid discharge 48 in the form of a pipe that may exit the specific riser segment 46 laterally and may turn vertically to couple to the fluid inlet of the pump(s) 42 when the box frame structure 51 is coupled to the specific riser segment 46. The fluid discharge 48 may be a metal forging having the capacity to withstand high external differential pressure (e.g., in excess of 600 pounds per square inch or 4.14 MPa) without crushing. As will be further explained, an upper end of the fluid discharge 48 may include a feature to facilitate connection of the pump module pump inlet (FIG. 11) to the upper end of the fluid discharge 48.

Figure 6:
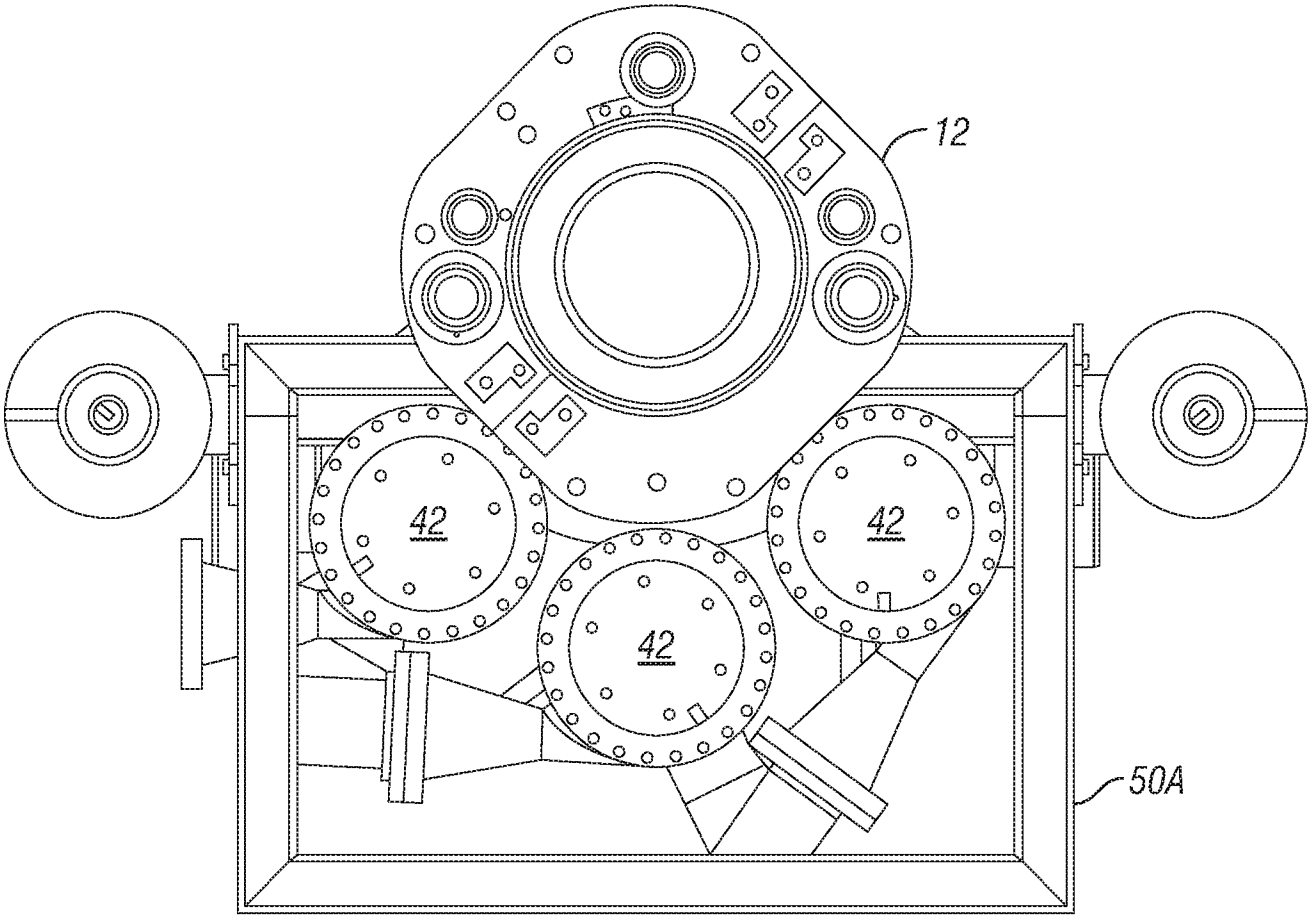
FIG. 6 shows the module of FIG. 5 in plan view.

FIG. 6 shows a plan view of the pump module 50A of FIG. 5 from above coupled to one side of the riser 12, and showing three fluid pumps 42, although the number of such pumps in any embodiment of the pump module 50A is not intended to limit the scope of the present disclosure. A possible advantage of using the vertical pump module configuration shown in FIGS. 4 through 6 is that such a pump module (either 50 in FIG. 4 or 50A in FIG. 5) may be mounted to the specific riser segment (called a "joint" and shown at 46 in FIGS. 4 and 5) using a modified blowout preventer (BOP) cart disposed under the platform (4 in FIG. 1), but still above the water surface (10 in FIG. 1), i.e., within the confines of the drilling unit (1 in FIG. 1). An example of such configuration will be explained below with reference to FIGS. 13 and 14.

Figure 7:
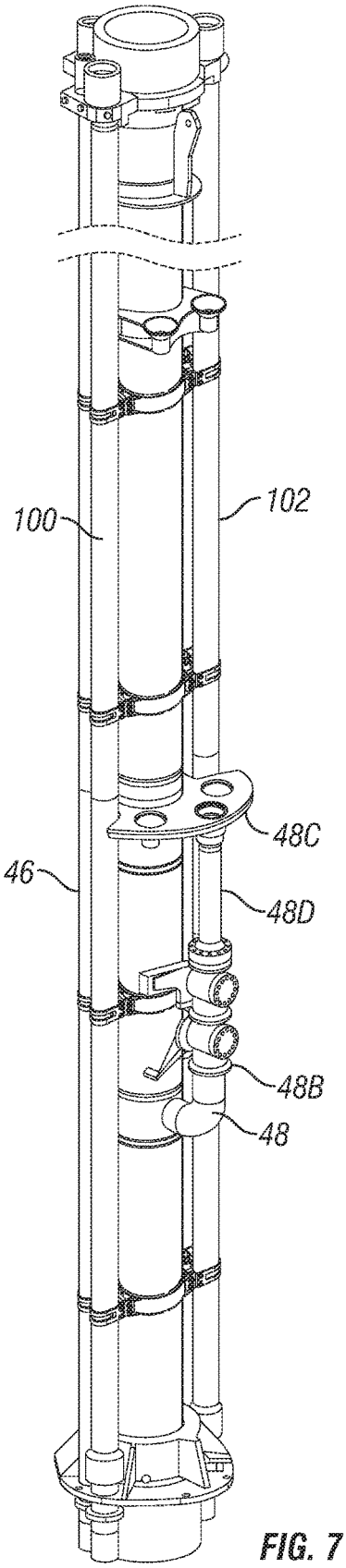
FIG. 7 shows the specific riser joint of FIG. 5 in more detail and shows module landing structure.
Figure 8:
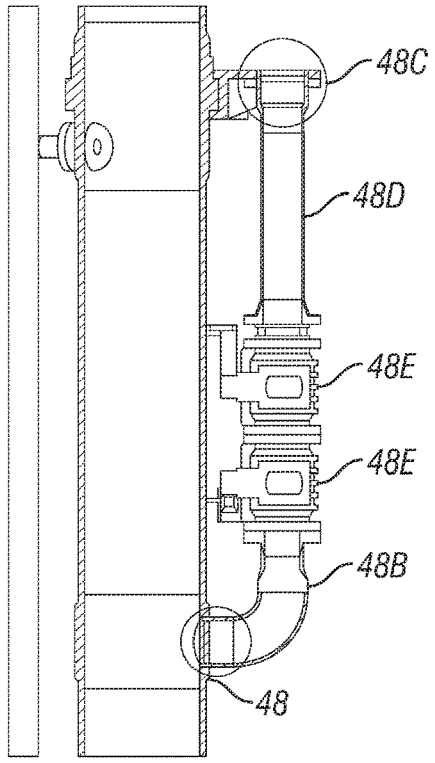
FIG. 8 shows details of the special riser joint and module landing structure.
Figure 9:
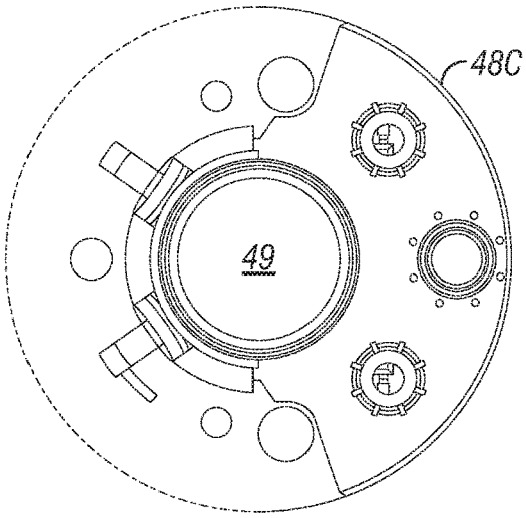
FIG. 9 shows a plan view of the landing structure.

FIG. 7 shows the example embodiment of the specific riser segment 46 in more detail, including the fluid discharge 48, the previously described pipe 48B, which may be a forged component, optional control valves 48E and a spool piece 48D leading from the control valves 48E to a docking structure 48C coupled to the specific riser segment 48. The foregoing components are shown in more detail in FIG. 8. A plan view of the docking structure 48C is shown in FIG. 9.

The specific riser segment 46 including the fluid discharge 48 and the docking structure 48C may be configured such that it will pass through the rotary table of the drilling unit (1 in FIG. 1), that is through an opening (not shown) in the deck (4 in FIG. 1), which on typical marine drilling platforms has an internal diameter limited to enable passage therethrough of the external diameter of the largest pipe-like structure used in construction of a sub-bottom borehole. Thus, embodiments of the pump module may not fit through such opening, but the pump module may be readily affixed to the riser (12 in FIG. 4) above the water surface but below the deck.

Figure 10:
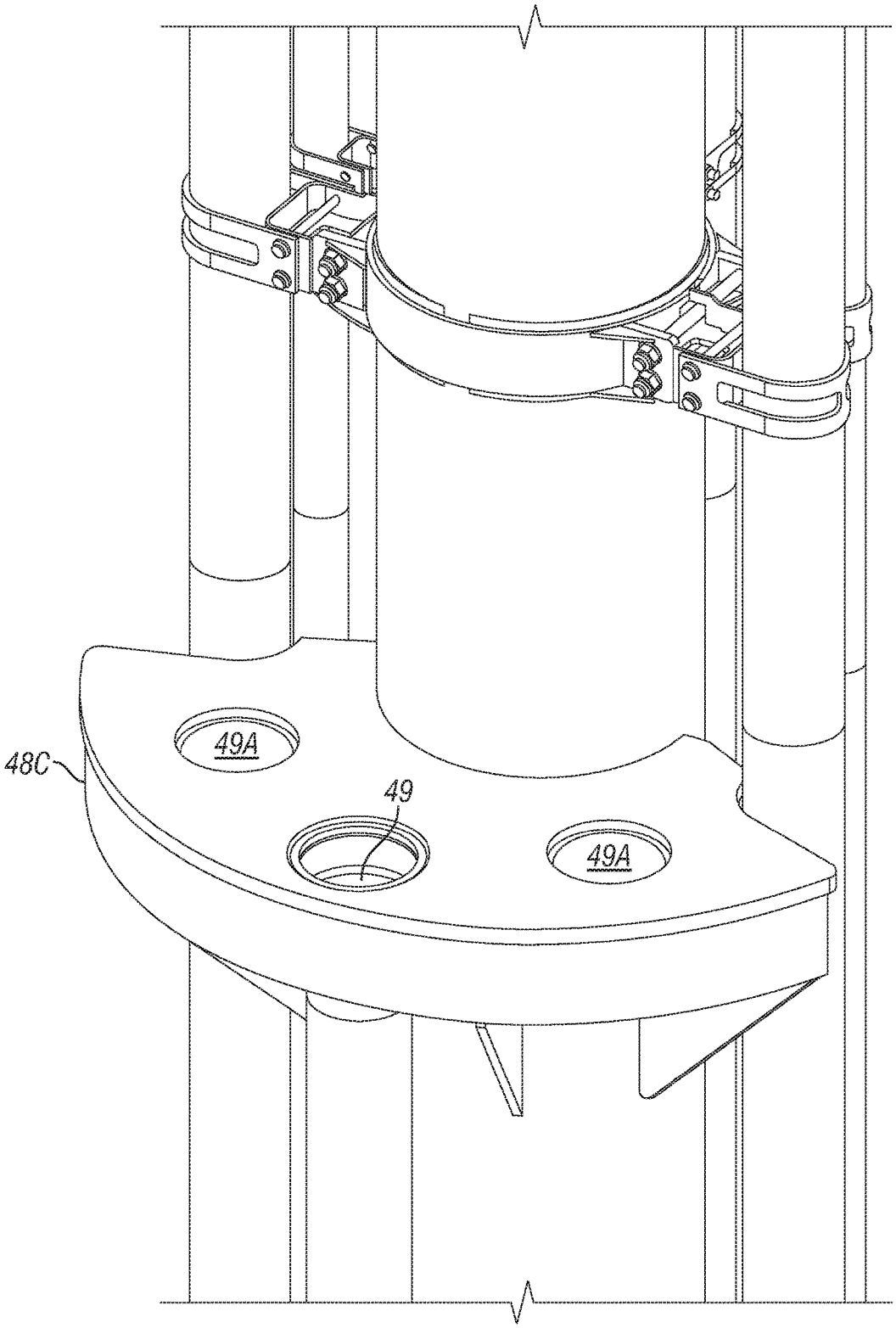
FIG. 10 shows an oblique view of the landing structure.

An enlarged view of the docking structure 48C is shown in FIG. 10. The opening to the spool piece (48D in FIG. 8) and thus to the fluid discharge (48 in FIG. 8) is shown at 49, and mates with a corresponding device coupled hydraulically to the intake of the pumps (42 in FIG. 6). Receptacles 49A may be provided for guide and locking pins to be received to engage the pump module (e.g., 50 in FIG. 4) to the docking structure 48C. As will be explained with reference to FIGS. 17 through 19, other types of modules may be mounted to the docking structure 48C using similar guide and locking pins to engage the receptacles 49A.

Figure 11:
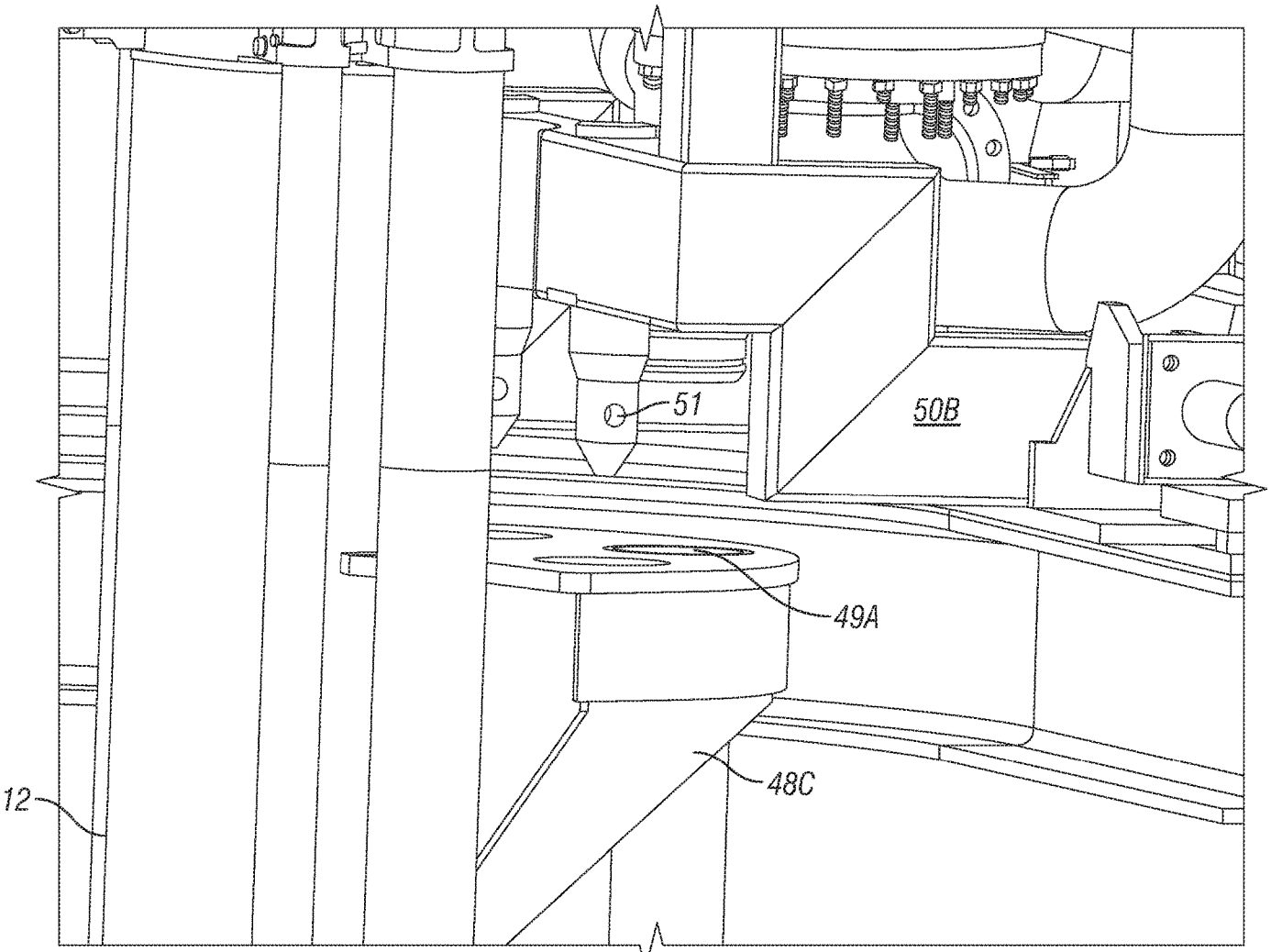
FIG. 11 shows locking pins that mount one of the interchangeable modules to the landing structure.

FIG. 11 shows an enlarged view of one of the guide and locking pins 51 approaching the corresponding receptacle 49A in the docking structure 48C. The guide and locking pins 51 may form part of or be affixed to the pump module frame 50B (or the box frame structure 51).

Figure 12:
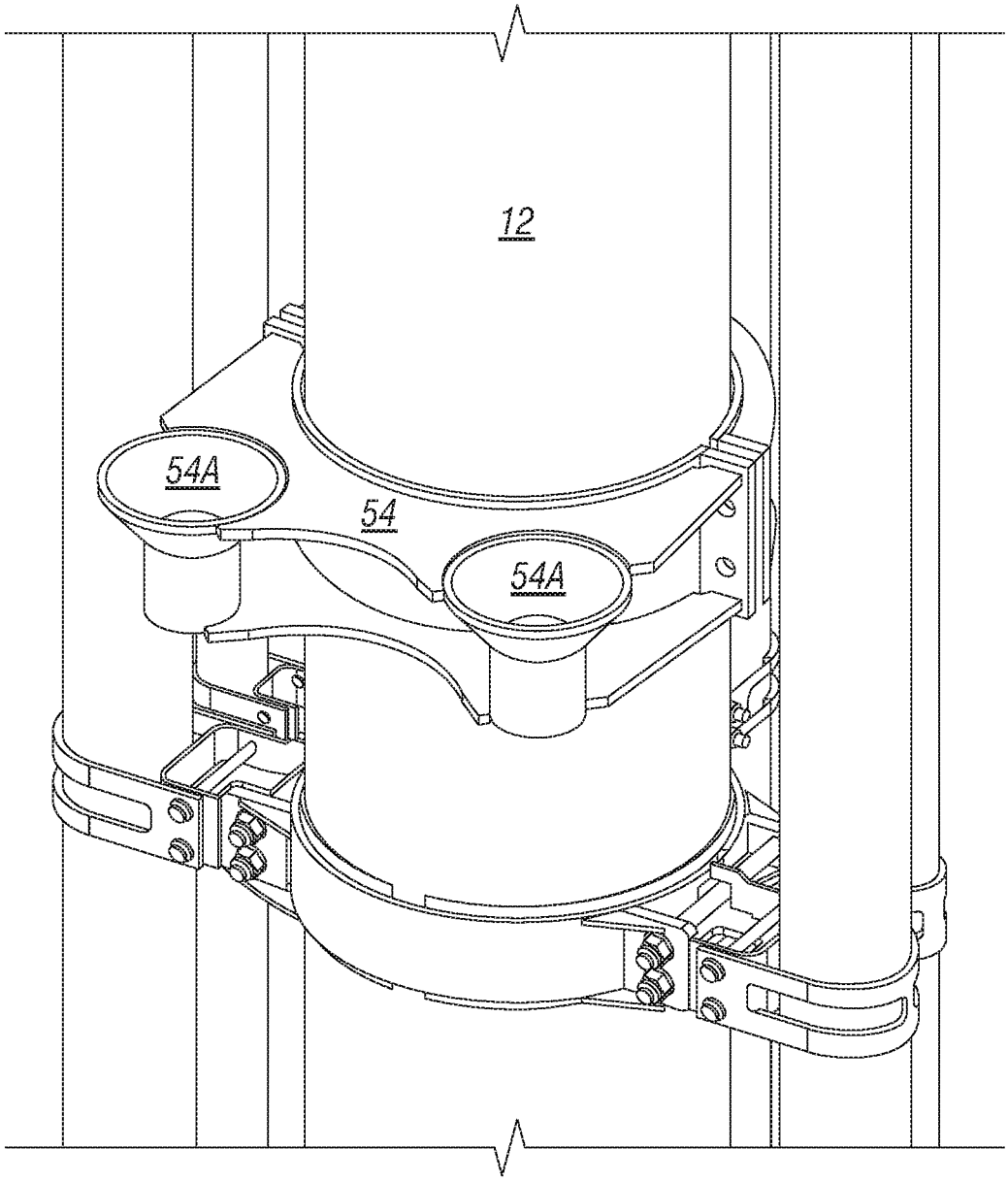
FIG. 12 shows an upper module retaining structure.

In FIG. 12, an upper pump module frame support 54 is shown clamped to the riser 12. The upper pump module frame support 54 may be affixed to the riser 12 after the pump module (50 in FIG. 4) is received in the docking structure (48C in FIG. 11) and moved so that it is effectively parallel to the riser 12. Corresponding pins (not shown) on the upper end of the pump module frame (50B in FIG. 11) may mate with openings 54A in the upper frame support 54.

Figure 13:
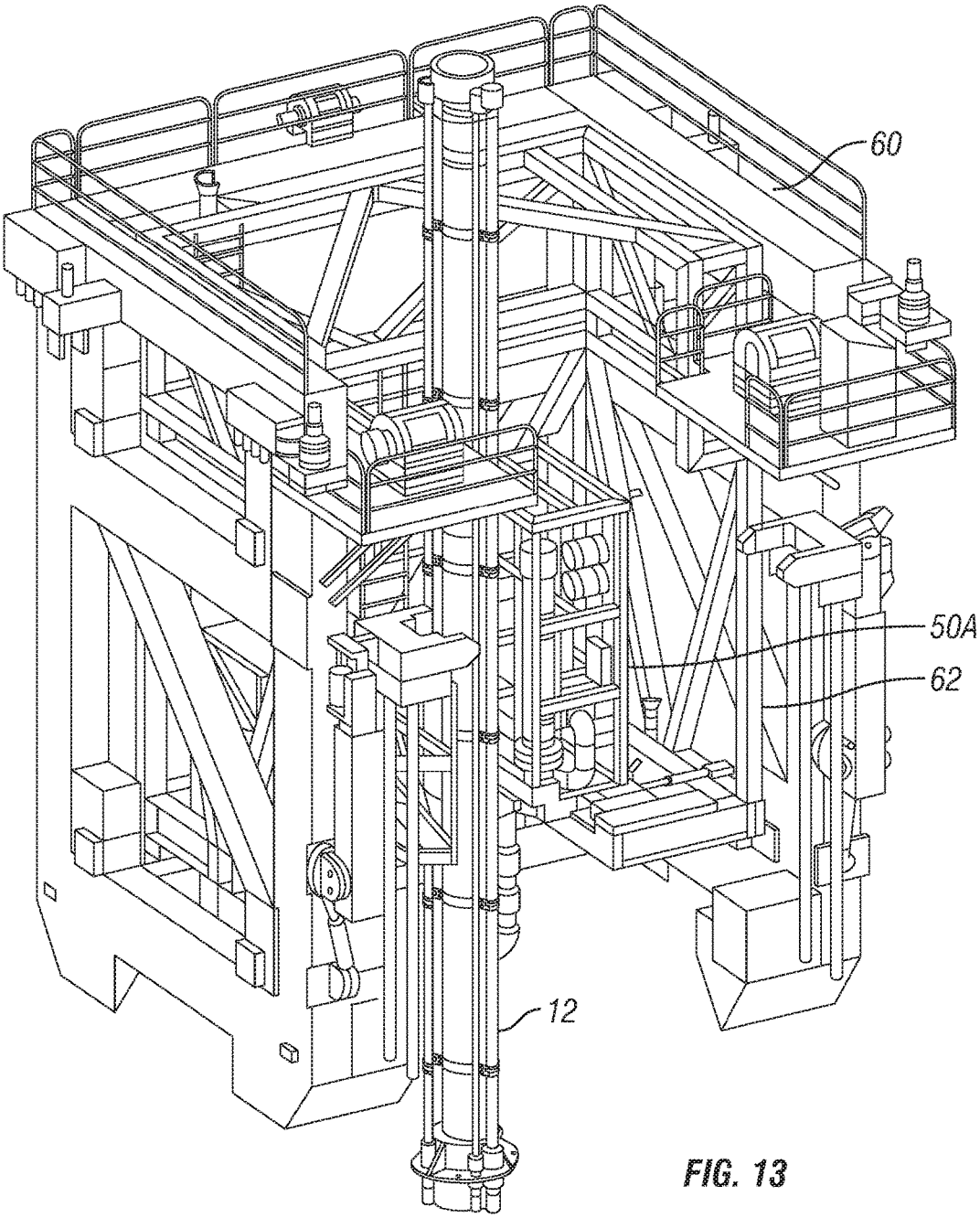
FIGS. 13 and 14 show two different views of a BOP cart (trolley) and an insert therefor to enable using the BOP cart to move one embodiment of an interchangeable module.
Figure 14:
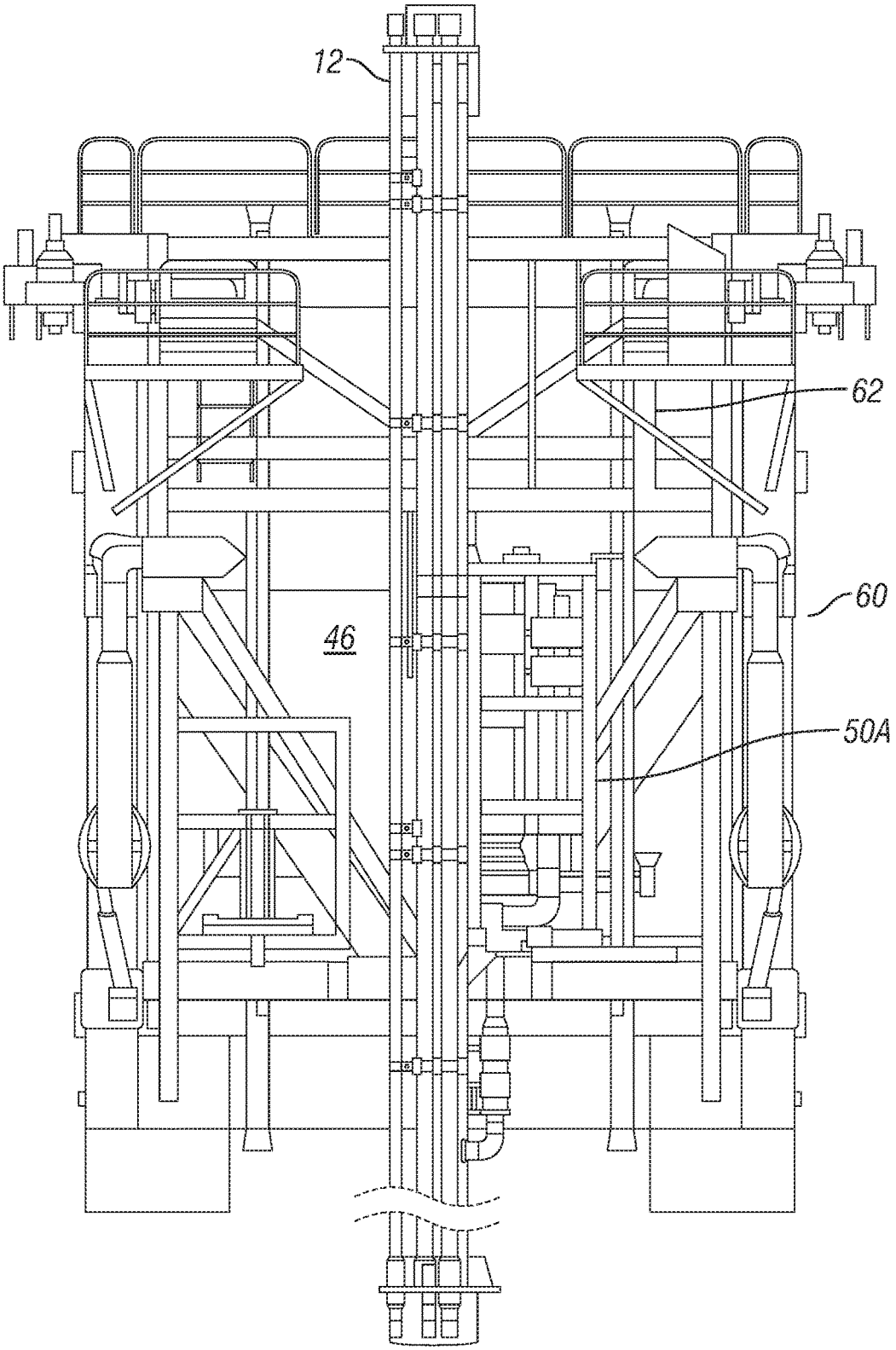

FIGS. 13 and 14 show two views of a BOP cart or trolley 60 typically used just below the deck (4 in FIG. 1) of the drilling unit (1 in FIG. 1) to assemble a blowout preventer ("BOP"—not shown) to the bottom end of a lower marine riser package (not shown) during assembly of the riser 12. The BOP cart 60 may include an insert 62 having dimensions selected to fit within or attach to the BOP cart 60 and retain the frame (51 in FIGS. 4 and 5) of the pump module 50A within or on the BOP cart 60. During assembly of the riser 12 the specific riser segment 46 as explained above is coupled into the riser 12. The riser 12 may be lowered by the drilling unit (1 in FIG. 1) until the specific riser segment 46 is below the deck (4 in FIG. 1) and is at the same elevation on the drilling unit as the BOP cart 60. The BOP cart 60 may be moved laterally until the frame 51 of the pump module 50A is in contact with the specific riser segment 46 as explained above. Mechanical and hydraulic connections to the pump module 50A may be made as explained above, and the riser 12 assembly may then continue as is otherwise ordinarily performed. A subsea wellhead or "tree" cart (not shown) may also be used to mount or remove any particular module, e.g., 50A, from the specific riser segment 46.

In some examples, the pipe 48B, valves 48E and spool piece 48D may be omitted. The specific riser segment 46 may include an opening (not shown) in the wall thereof that mates to a corresponding feature hydraulically connected to the fluid intake of the fluid pump(s) when a pump module (e.g., 40 in FIG. 2, 50 in FIG. 4 or 50A in FIG. 5) is coupled to the specific riser segment 46. Such opening and pump module feature may form a pressure tight seal when the pump module (e.g., 40 in FIG. 2, 50 or 50A in FIG. 4 or 5) is assembled to the specific riser segment 46.

It will also be appreciated by those skilled in the art that any of the foregoing embodiments of a pump module may be disconnected from the riser (12 in FIG. 1) and moved to the drilling unit (1 in FIG. 1) in the event of pump module component malfunction. Such operation may be performed with the riser (12 in FIG. 1) fully assembled from the drilling unit (1 in FIG. 1) to the BOP (104 in FIG. 1) of the borehole (15 in FIG. 1), typically proximate the water bottom (8 in FIG. 1). The pump module may be removed from the riser, for example by a remotely operated vehicle (ROV) and lifted by a winch to the drilling unit (1 in FIG. 1) for repair or replacement. During such retrieval operation, the borehole operator may or may not remove the drill string (16 in FIG. 1) from the borehole (15 in FIG. 1), but the borehole operator may close one or more inflatable annular seal elements or "rams" in the BOP (104 in FIG. 1) for safety reasons, e.g., to prevent borehole fluid pressure from escaping through the opening in the specific riser segment (46 in FIGS. 13 and 14).

Figure 15:
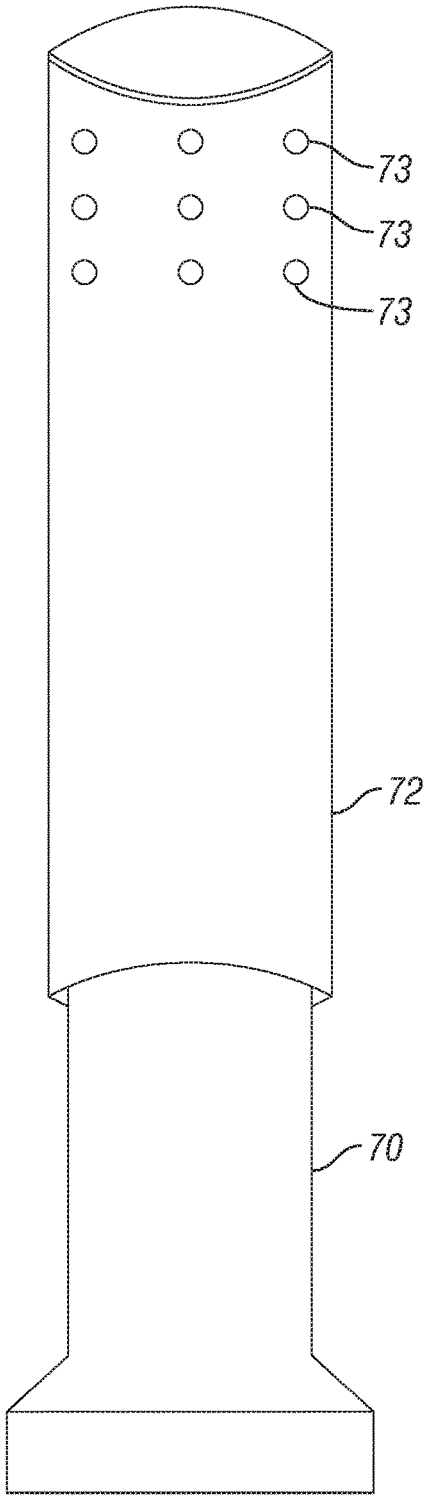
FIGS. 15 and 16 show a "soft landing" structure to enable any one of the interchangeable modules to make wet connections to the structure.
Figure 16:
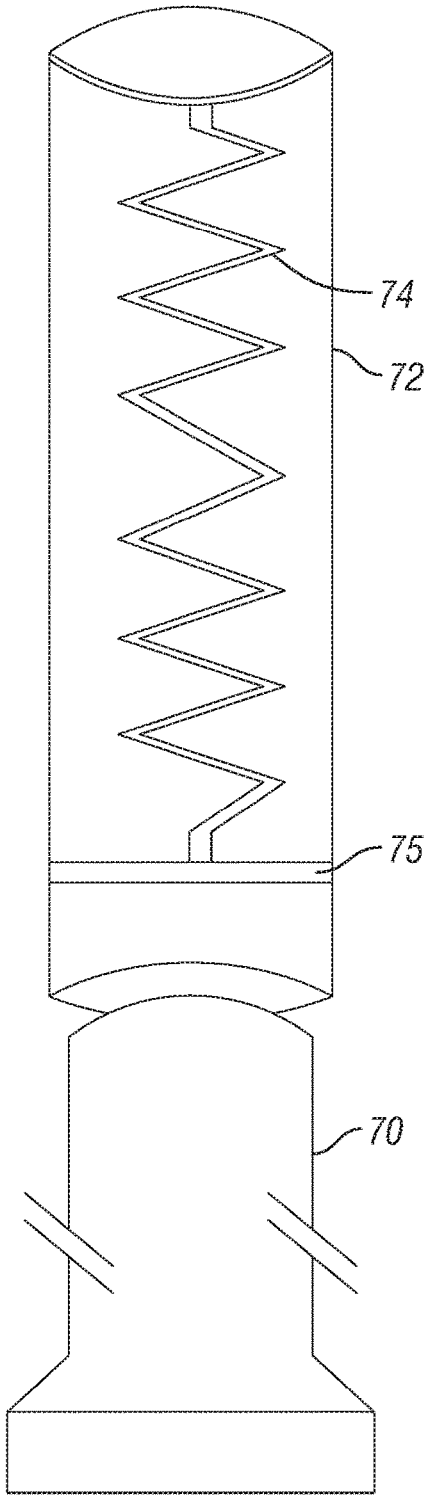

In another example, and referring to FIGS. 15 and 16, one or more "soft landing" elements may be affixed to the docking structure (48C in FIG. 7) or to the upper landing structure (54 in FIG. 12). The soft landing element(s) may include one or more guide posts 70 affixed to either the docking structure or the upper landing structure. A cylinder 72 having ports 73 in an upper end, and a spring 74 and piston 75 coupled to the spring 74 may be affixed to the pump structure. Such soft landing element(s) may slow or cushion the rate of engagement of the pump structure to the docking structure or upper landing structure, thereby reducing the possibility of damage and enabling wet coupling of the pump and lines.

The foregoing example module contains one or more fluid pumps to assist in lifting drilling fluid from the borehole (15 in FIG. 1) to the drilling unit (1 in FIG. 1) so that hydrostatic pressure in the borehole may be better controlled, e.g., reduced below the hydrostatic pressure exerted by an equivalent height and density column of fluid in the absence of such pump(s). The module and docking structure configuration described herein enables servicing and/or replacement of the module without the need to disassemble the riser or to operate at great water depth. The module configuration may enable other types of hydraulic devices and/or hydraulic line configuration to be included in different modules without changing the riser or auxiliary line structure. Examples of different types of "dockable" modules that may be connected to the specific riser joint will now be explained with reference to FIGS. 17-20.

When a system according to the present disclosure is designed, certain types of control valves may preferably be located within the dockable module rather than on the riser or the specific riser segment. In cases where "double block valves" are required, one such valve may be arranged on the specific riser segment and the other such valve disposed on the dockable module. In this way, when a dockable module is connected and locked in place, the riser system has its full designed operating pressure rating and integrity. When a dockable module is removed for repair or replacement, the specific riser segment may be isolated form the surrounding sea, but does not have full pressure integrity. If the riser or an auxiliary line can be left open and in fluid communication with the ambient sea when a module is removed, all control valves may be disposed inside the dockable module.

Possible benefits of a riser system having dockable modules according to the present disclosure are that multiple lines, valves and connections to the specific riser segment may be made in a compact manner allowing the specific riser segment to be run through the drilling unit deck as would be the case in conventional marine riser assembly and running (or removal). Another possible benefit is that various operational modes may be possible with one dockable module or by switching and/or replacing the dockable module with a differently configured dockable module.

Figure 17:
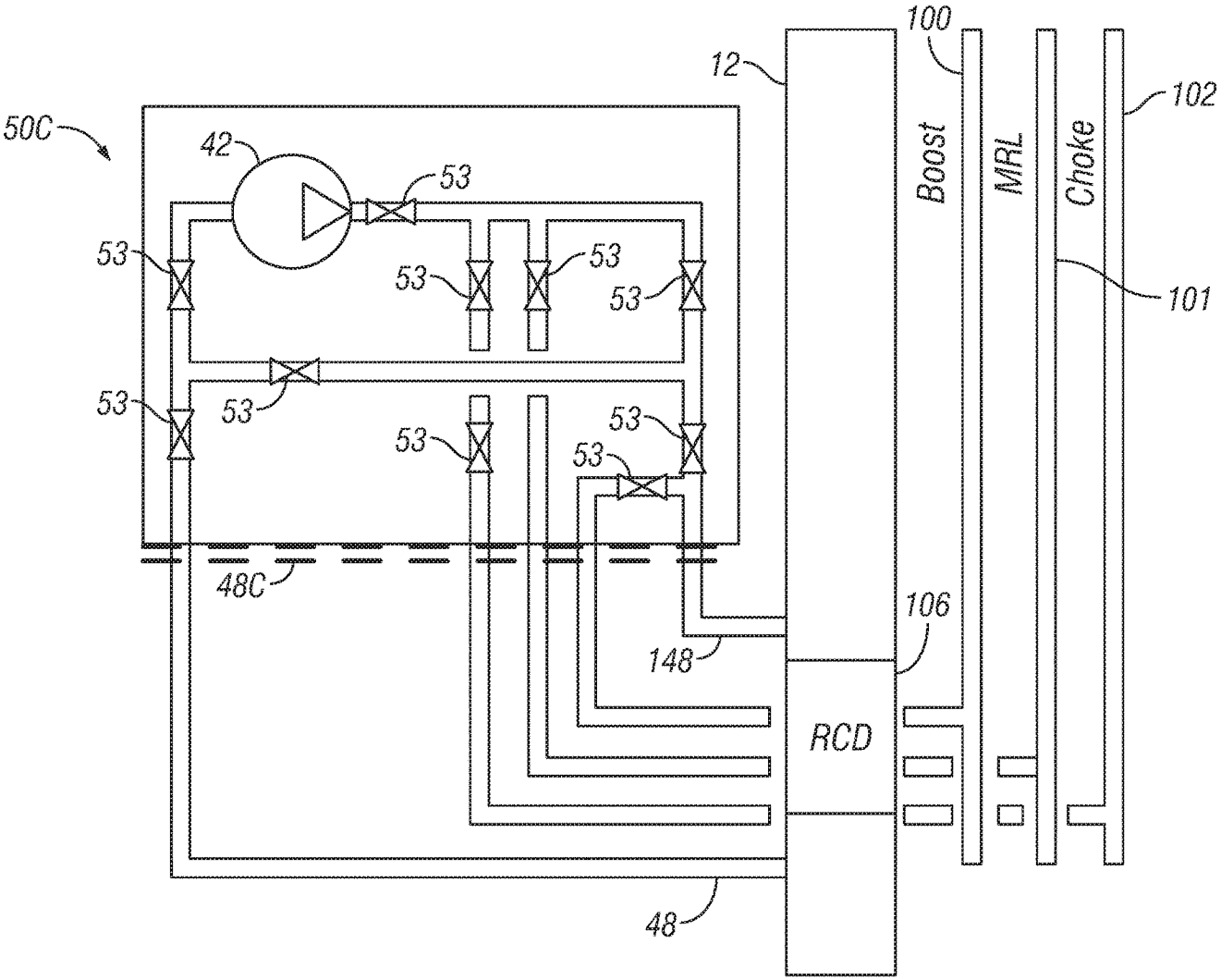
FIGS. 17 through 20 show various examples of interchangeable dockable modules used for various drilling configurations that may be attached to a docking structure on a riser.

FIG. 17 shows one type of dockable module that may be referred to as a "universal" configuration pump module 50C. The pump module 50C structure or frame may be, for example, substantially as described above with reference to FIG. 4 or FIG. 5, wherein hydraulic components are mounted in a box frame or structure (51 in FIG. 4) that may be lowered to rest on the docking structure 48C. The fluid line extending to the fluid exit in the riser 12 is shown at 48, just as in FIGS. 4 and 5. An example fluid pump is shown at 42. The pump may be configured as explained with reference to FIGS. 5 and 6, however such pump configuration is not intended to limit the scope of the present example. An hydraulic connection 148 from the module (through the docking structure 48) may be made to the riser 12 above a rotating control device or similar device (RCD) 106 disposed in the riser longitudinally at about the level of the module 50B. The RCD 106 may provide hydraulic isolation between the fluid exit 48 and the hydraulic connection 148 when the drill string (16 in FIG. 1) is disposed in the riser, although the drill string need not extend all the way into the borehole (15 in FIG. 1) to perform the function of isolation just described. Hydraulic connections between the module 50C and each of the auxiliary lines, such as boost line 100, choke line 102 and a drilling fluid (mud) return line 101 may be made through the docking structure 48C in a manner similar to what is shown in and explained with reference to FIGS. 7 through 10. It is only required to add additional ports and lines (such as the one shown at 49 in FIG. 10) to the docking structure 48C to accommodate each fluid line to be connected to the module 50C. In the universal pump configuration module 50C shown in FIG. 17, a plurality of valves 53 may be used to selectively perform hydraulic functions such as bypassing the pump(s) 42, isolating the fluid discharge 48 from the hydraulic connection 148, redirecting flow from the pump(s) 42 to one of the auxiliary lines 100, 102 or to the mud return line 101. It should be noted that the mud return line MRL may be used in certain drilling system configurations in which a rotating control device is used in a suitable receptacle (not shown) in the BOP stack (104 in FIG. 1), wherein drilling fluid returning from the borehole (15 in FIG. 1) is diverted to the mud return line MRL and does not pass through the riser (12 in FIG. 1). The universal configuration pump module 50C may be used for "closed system" mud lift drilling, wherein fluid in the riser 12 above the RCD 106 is hydraulically isolated from the drilling fluid in the borehole (15 in FIG. 1). The universal configuration pump module 50C may also perform "open system" mud lift drilling, wherein part of the hydrostatic pressure exerted on the borehole (15 in FIG. 1) is maintained by maintaining a selected fluid level in the riser 12. Still further, the universal pump configuration module 50C shown in FIG. 17 may be used to perform various well pressure control event management methods, for example one such as described in U.S. Pat. No. 8,413,722 issued to Cohen. Still further, the universal configuration pump module 50C shown in FIG. 17 may be configured to perform Pressurized Mud Cap Drilling (PMCD).

Figure 18:
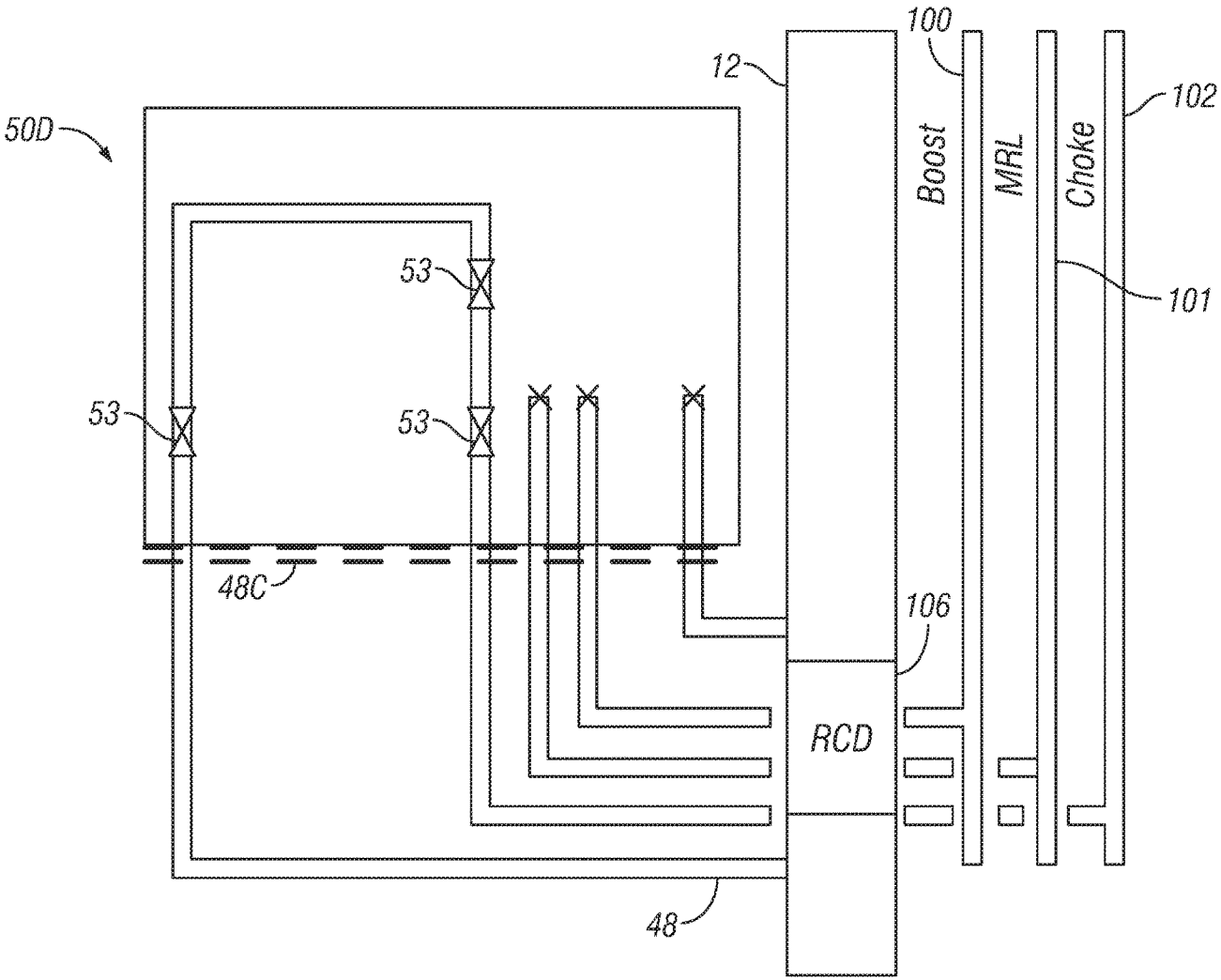

Another configuration of dockable module shown at 50D in FIG. 18 may be configured for Pressurized Mud Cap Drilling (PMCD) only. In this configuration a connection is established from the closed riser volume below the RCD 106 to the "choke" line 102. The module 50D may omit the pump(s) shown in FIG. 17 and may have hydraulic closures such as caps to seal the ports to the docking structure 48C for the hydraulic line 148 above the RCD 106, the mud return line 101 and one or more of the auxiliary lines, e.g., at 100. In the present example, the capped auxiliary line 100 may be the so called "boost line" through which fluid is pumped from the drilling unit (1 in FIG. 1) to the lower part of the drilling riser 12. The module 50C may include valves 53 to selectively close an hydraulic connection from the fluid exit 48 to the "choke" line 102, so called because it typically includes a selected size or variable size orifice or flow restriction called a choke (not shown) proximate the drilling unit (1 in FIG. 1).

Figure 19:
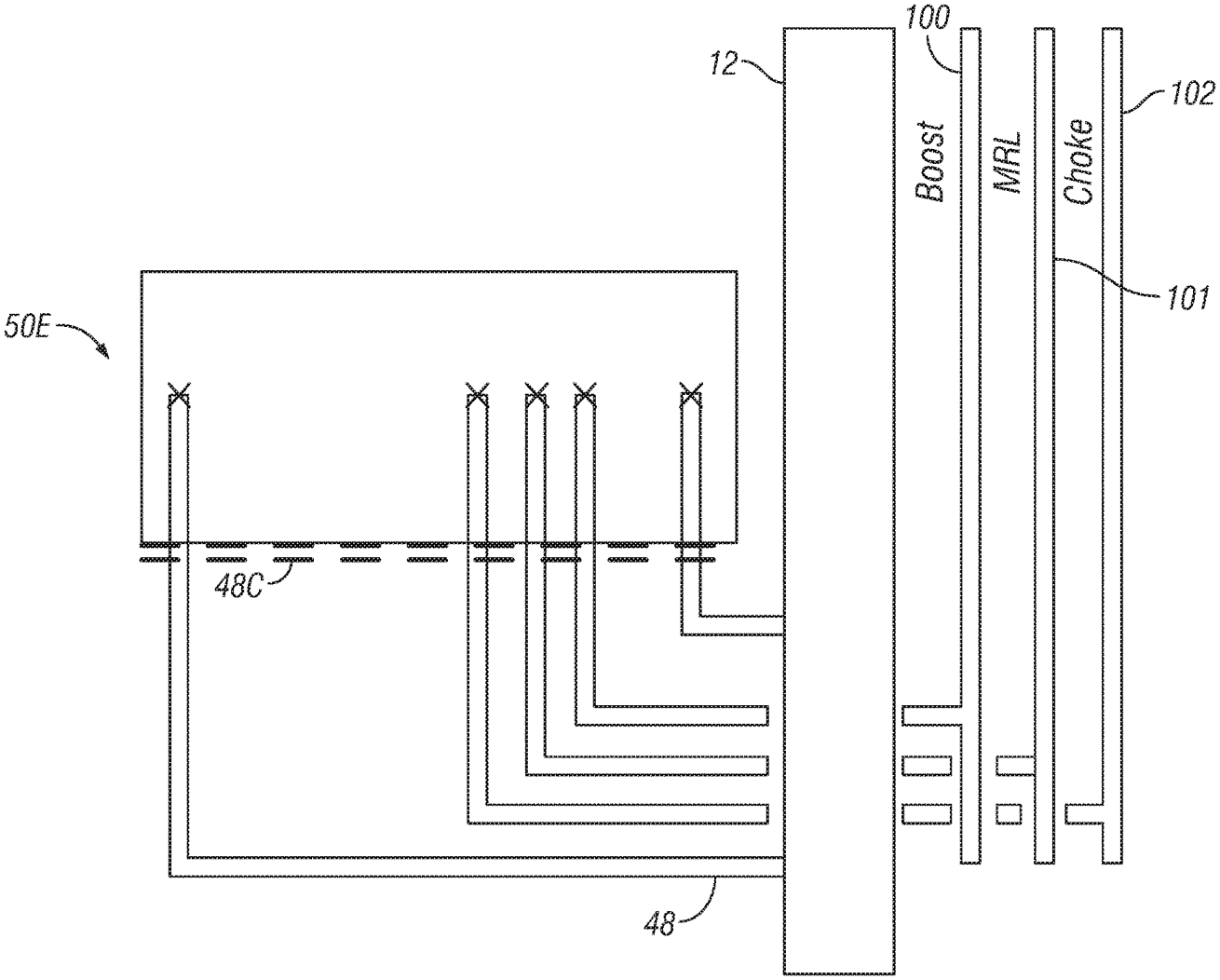

Another example dockable module is shown at 50E in FIG. 19. The example in FIG. 19 has hydraulic closures for all the lines connected to the docking structure 48C. Thus, the example module 50E shown in FIG. 19 may be used to reconfigure the riser segment for conventional drilling, in circumstances where any of the above mentioned features are unlikely to be used (thus obviating the need for a universal module such as shown in FIG. 17 with the pump(s) bypassed and the other lines closed by operation of the valves).

In the foregoing examples shown in FIGS. 17 and 18, the valves 53 may be hydraulically or electrically operated so that they may be remotely controlled by suitable control devices (not shown) disposed on the drilling unit deck 4 or other convenient location.

Figure 20:
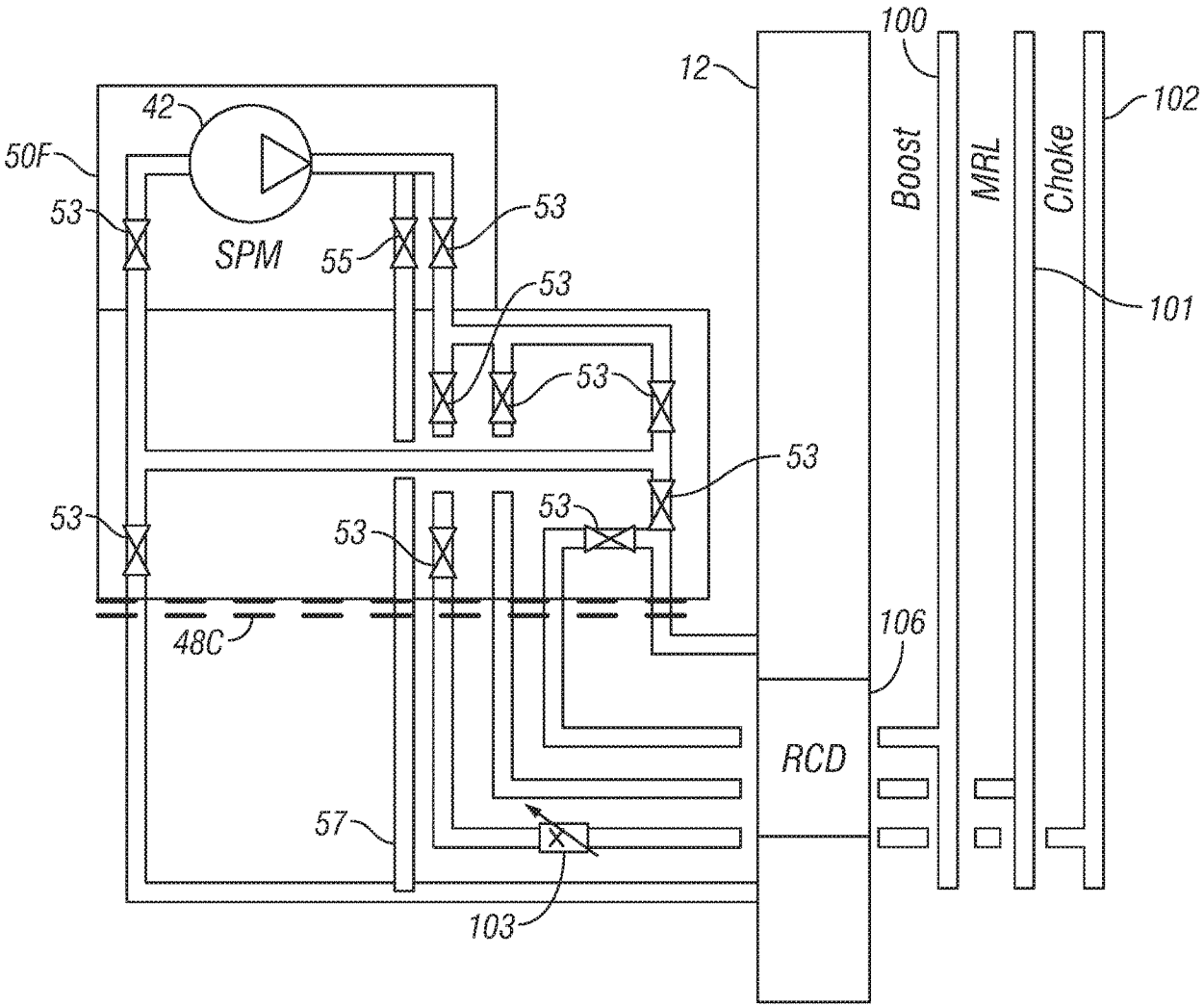

FIG. 20 shows another type of dockable module that may be referred to as a "universal" configuration pump module 50F. The dockable module 50F may include all the features in the example embodiment described with reference to FIG. 17 and includes an additional pump discharge line 57 having an in line valve 55, which may similar to the other valves 53. The embodiment shown in FIG. 20 may be used to reverse flow produced by the fluid pump 42. Reverse flow may be obtained by opening valve 55 so that discharge from the fluid pump 42 may move through a discharge line 57 into the interior of the riser 12 below the RCD 106. Selected ones of the other valves 53 may be opened to hydraulically connect the fluid inlet of the fluid pump 42 to the interior of the riser 12 above the RCD 106 or to one of the auxiliary lines, e.g., 100, 101, 102.

In other embodiments, the fluid pump 42 may be configured to move fluid reversibly, e.g., by changing direction of rotation of a motor used to drive the fluid pump.

Reversing flow of the fluid pump 42 may enable a dockable modular pump system as described herein to be used with back pressure drilling methods. Back pressure drilling methods are used to maintain a borehole pressure greater than the pressure that would be exerted by a static column of selected density drilling fluid in the borehole. In various forms, back pressure drilling methods elevate drilling fluid pressure by restricting fluid flowing out of the borehole, e.g., through mud return line 101, using a choke or variable orifice restriction in the fluid discharge from the borehole. An example variable orifice restriction or choke is shown in FIG. 20 at 103. In the present example embodiment, the variable orifice choke 103 may be part of the dockable module 50F. In other embodiments, the variable orifice choke may be disposed in or proximate a surface termination of any of the auxiliary lines, for example, the choke line 102.

The borehole fluid discharge is sealed by a RCD 106. The drilling fluid is pumped down through the drill string (16 in FIG. 1) using a mud pump (27 in FIG. 1) which the lifts drilling fluid from a storage tank (29 in FIG. 1) and the discharges the drilling fluid under pressure to the interior of the drill string (16 in FIG. 1). The actual pressure exerted by the drilling fluid at any depth in the borehole depends on, among other parameters, the rate of flow of the drilling fluid into the borehole, the density of the drilling fluid, the annulus (30 in FIG. 1) cross sectional area and the viscosity of the drilling fluid. The combined pressure of the hydrostatic pressure of the drilling fluid and increased pressure required to keep the drilling fluid circulating result in a pressure in the borehole at any depth that may be expressed in terms of an equivalent pressure gradient. The equivalent pressure gradient is referred to as the equivalent circulating density (ECD). ECD may be increased for any selected density of drilling fluid by, individually or in any practical combination, reducing the flow area of the variable orifice choke 103 and increasing the flow rate of the drilling fluid pump (27 in FIG. 1). During times when the drilling fluid pump (27 in FIG. 1) must be switched off, ECD will decrease to the hydrostatic pressure exerted by the drilling fluid because of reduced or eliminated frictional pressure drop of the drilling fluid. In order to maintain ECD at a selected value, or to maintain borehole pressure at any depth at a selected pressure, the fluid pump 42 may be operated as explained above such that its discharge is directed to the interior of the riser 12. By discharging fluid under pressure into the interior of the riser 12 below the RCD 106, the borehole pressure may be maintained above the hydrostatic pressure exerted by the drilling fluid. When the drilling fluid pump (27 in FIG. 1) is started, the fluid pump may be switched off, such that ECD or selected pressure in the borehole is maintained as frictional pressure in the borehole increases. Once the fluid pump 42 is switched off, the variable orifice choke 103 may be operated to maintain ECD or selected borehole pressure.

The example embodiment shown in FIG. 20 may be used for both reducing borehole pressure by lifting fluid from the borehole and pumping it to the drilling platform and for increasing borehole pressure above hydrostatic pressure by reversing the hydraulic connections of the fluid pump 42 so that fluid is moved into the interior of the riser below the RCD 106.

In another example embodiment, more than one of the specific riser joints (e.g., as shown in FIGS. 7 through 10) may be joined end to end or may be included in the riser (12 in FIG. 1) at a selected axial spacing along the riser. In the present example embodiment, the same or different kinds of interchangeable modules may be coupled to each of the specific riser segments. In the present example, the specific riser segment may be coupled within the riser so that the respective docking structures (48C in FIGS. 17-19) are on opposed circumferential sides of the riser. Such configuration may more evenly distribute load on the riser (12 in FIG. 1).

An interchangeable, riser-mounted hydraulic control dockable module and corresponding mating riser segment (joint) according to the various aspects of the invention may make assembly of various fluid return and control systems more efficient.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drilling riser system comprising:

at least a first interchangeable dockable module having sealable hydraulic connections and configured to connect to a module docking structure disposed in at least one specific segment of a drilling riser and to seal the hydraulic connections;

wherein the at least a first interchangeable dockable module comprises, one of the sealable hydraulic connections to each of a first fluid conduit in fluid communication with the drilling riser above a rotating control device and at least one auxiliary line associated with the drilling riser, the first interchangeable dockable module comprising a fluid pump, and a plurality of valves enabling the at least a first interchangeable dockable module to be configurable to perform any of pressurized mud cap drilling, mud lift drilling with open riser, mud lift drilling with closed riser and drilling with unlifted mud return; and wherein the at least a first dockable module comprises additional valves and a second fluid conduit coupled between a discharge of the fluid pump and the riser and in fluid communication with the riser below the rotating control device in the riser.

2. The drilling riser system of claim 1 wherein the plurality of valves selectively connects a pump inlet and the pump discharge to any one of a plurality of auxiliary lines or the first fluid conduit, or to selectively bypass the fluid pump.

3. The drilling riser system of claim 1 further comprising a plurality of additional interchangeable dockable modules, each of the plurality of additional interchangeable dockable modules configured for a predetermined drilling configuration.

4. The drilling riser system of claim of claim 3 wherein at least one of the plurality of additional interchangeable dockable modules comprises hydraulic connections on the module docking structure to the first fluid conduit and to a plurality of auxiliary lines associated with the riser.

5. The drilling riser system of claim 3 wherein at least one of the plurality of additional interchangeable dockable modules comprises a plurality of valves to selectively connect the first fluid conduit to the auxiliary line.

6. The drilling riser system of claim 2 wherein the rotating control device is disposed in a drilling riser segment above a point at which the second fluid conduit is in fluid communication with an interior of the riser.

7. The drilling riser system of claim 6 further comprising at least one additional controllable valve in the at least a first interchangeable dockable module arranged to place the pump discharge in hydraulic communication with the interior of the drilling riser below the rotating control device, and wherein the controllable valve is arranged to place the pump inlet in hydraulic communication with either (i) one of the plurality of auxiliary lines or (ii) the interior of the drilling riser above the rotating control device.

8. The drilling riser system of claim 2 wherein the at least a first interchangeable dockable module comprises a box frame structure mounted to one side of the riser.

9. The riser system of claim 1 further comprising at least one soft landing structure configured to slow a rate of engagement of the at least a first interchangeable dockable module with the module docking structure.

10. The riser system of claim 1 further comprising at least one additional module docking structure affixed to a segment of the drilling riser, the at least one additional module docking structure including an hydraulic connector to at least one fluid conduit in fluid communication with an interior of the drilling riser and at least one hydraulic connector in fluid communication with the at least one auxiliary line associated with the riser.

11. The drilling riser system of claim 1 further comprising at least a second interchangeable dockable module having a plug corresponding to each of the sealed hydraulic connections on the first interchangeable dockable module to configure the drilling riser to perform drilling with unlifted mud return when the second interchangeable dockable module is coupled to the module docking structure in place of the first interchangeable dockable module.

12. A method for wellbore drilling, comprising:

pumping drilling fluid into a drill string extending into the wellbore through a riser, the riser extending from a wellhead to a drilling platform on the surface of a body of water;

sealing an annular space between the drill string and the riser using a rotating control device;

returning drilling fluid from the wellbore from a fluid outlet disposed at a position between the bottom of the wellbore and a position of the rotating control device;

maintaining a selected fluid pressure in the wellbore by (i) at least one of (A) restricting flow of fluid through the outlet and (B) pumping fluid from the fluid outlet to the drilling platform when the pumping drilling fluid is being performed and (ii) pumping fluid into the fluid outlet when the pumping drilling fluid is stopped such that the selected fluid pressure exceeds a hydrostatic pressure of the drilling fluid in the wellbore, wherein the pumping fluid into the fluid outlet comprises operating a pump module coupled to the riser, the pump module comprising a fluid pump, and a plurality of controllable valves enabling selective fluid connection of a fluid inlet or a fluid discharge of the fluid pump to the fluid outlet, and enabling selective fluid connection of the discharge of the fluid pump to an interior of the riser between either (i) the rotating control device and the drilling platform on the one axial side or (ii) a fluid line extending from the pump module to the drilling platform; and withdrawing fluid from the riser above the rotating control device in the riser and discharging the fluid into the riser below the rotating control device through the fluid outlet.

13. The method of claim 12 wherein the maintaining fluid pressure comprises pumping fluid from the fluid outlet to the drilling platform when the pumping drilling fluid is performed and pumping fluid from the drilling platform into the fluid outlet when the pumping drilling fluid is stopped.

14. The method of claim 13 wherein a direction of pumping fluid between the fluid outlet and the drilling platform is changed by changing direction of operation of the fluid pump.

15. The method of claim 12, further comprising replacing the pump module with a blank module comprising a plug corresponding to each of a plurality of hydraulic connections to configure the riser to perform drilling with unlifted mud return.

* * * * *